United States Patent [19]

Thistle et al.

[11] Patent Number: 4,813,354

[45] Date of Patent: Mar. 21, 1989

[54] DAMPENING SYSTEM FOR PRINTING MACHINES

[75] Inventors: Robert E. Thistle, Scarborough; Steven T. Thistle, Toronto, both of Canada

[73] Assignee: Robert E. Thistle Limited, Scarborough, Canada

[21] Appl. No.: 66,762

[22] Filed: Jun. 24, 1987

[30] Foreign Application Priority Data

Oct. 9, 1986 [CA] Canada ..... 520198

[51] Int. Cl.[4] ..... B41F 7/40

[52] U.S. Cl. ..... 101/148; 101/350

[58] Field of Search ..... 101/148, 350, 147

[56] References Cited

U.S. PATENT DOCUMENTS

| | | | |
|---|---|---|---|
| 2,103,254 | 12/1937 | Goedike | 101/148 |
| 3,106,154 | 10/1963 | Saul | 101/350 X |
| 3,293,097 | 12/1966 | Peterson et al. | 101/148 X |
| 3,326,122 | 6/1967 | Wildeman | 101/148 |
| 3,749,011 | 7/1973 | Abendroth et al. | 101/148 |
| 4,130,057 | 12/1978 | List et al. | 101/148 |
| 4,440,081 | 4/1984 | Beisel | 101/148 |
| 4,524,690 | 6/1985 | Omori | 101/148 |
| 4,676,156 | 6/1987 | Aylor et al. | 101/148 |

*Primary Examiner*—Clifford D. Crowder

*Attorney, Agent, or Firm*—Sim & McBurney

[57] ABSTRACT

A dampening system for a printing apparatus incorporates a water fountain and a fountain roller partly immersed in water held in the water fountain. A metering roller is pivotally mounted for swinging movement about the axis of the fountain roller. A form roller is provided, along with a drive for positively rotating the form roller. An oscillator roller is in contact with the form roller, and the dampening system is such that water can pass from the metering roller to the oscillator roller. This includes a receiving roller which is such that the metering roller is pressed by gravity against the receiving roller. A motor is provided for driving the fountain roller in rotation. In one embodiment, the receiving roller is the oscillator roller, whereas in another embodiment, the receiving roller is a separate transfer roller in contact with both the oscillator roller and the metering roller.

10 Claims, 2 Drawing Sheets

DAMPENING SYSTEM FOR PRINTING MACHINES

This invention relates generally to a dampening system for printing machines, and has to do particularly with an improved dampening system which overcomes a number of the drawbacks inherent in prior constructions.

BACKGROUND OF THIS INVENTION

There are two prior constructions which are exemplary of the conventional approach to a dampening system for a printing apparatus, both of which are in use with the standard offset printing machines.

The first of these prior devices incorporates a cloth-covered form roller adapted to contact and feed water to a plate cylinder, a metal oscillator roller mounted to be in continuous contact with the form roller, and to oscillate back and forth in an axial direction in order to promote the even distribution of water on the surface of the form roller, a fountain roller adapted to be partly immersed in water contained in a water fountain, and lastly a cloth-covered ductor roller held at the ends of pivotally mounted swing arms in such a way that the ductor roller can pivot between a first position in which it is in contact with the fountain roller and out of contact with the oscillator roller, and a second position in which it is out of contact with the fountain roller and in contact with the oscillator roller. The ductor roller is typically cloth covered to allow it to absorb a substantial quantity of water from the fountain roller, prior to transfer over to the oscillator roller.

One of the major disadvantages of the arrangement just described is its tendency to prodce an uneven distribution of water on the oscillator, and thus on the form roller to which the oscillator feeds water. The water is transferred in discrete batches, and when the ductor roller is in contact with the fountain roller, no water is being passed to the oscillator roller.

The second conventional arrangement is one in which a form roller is in contact with a plate cylinder, and simultaneously in contact with a transfer roller and with an oscillator roller at two different locations on the form roller. The transfer roller is in turn in contact with a fountain roller which is partly immersed in water contained in a water fountain.

One of the difficulties with this second prior art construction relates to the complexity of the arrangement, and the difficulty of assembly and disassembly.

A particular drawback, which applies to the first of the constructions described above, relates to the limited range of rotational speeds for the fountain roller. The typical prior art construction utilizes a ratcheting system for rotating the fountain roller, thus producing a somewhat intermittent water feed. Further, the ratcheting system is either not adjustable in terms of speed, or only adjustable in a very limited sense, thus not allowing the operator sufficient scope of adjustment to match water feed with water usage during the printing process.

GENERAL DESCRIPTION OF THIS INVENTION

In view of the above drawbacks of the conventional constructions, it is an object of an aspect of this invention to provide an improved dampening system for printing apparatus in which the drive of the fountain roller is infinitely variable, continuous and smooth.

It is an object of a further aspect of this invention to replace the intermittent feed of the ductor roller known in the prior constructions with a means capable of a smoother metering of water.

Finally, it is an object of yet another aspect of this invention to provide a construction for a dampening system which avoids springs and other mechanisms, and utilizes gravity to bring about the force pressing one roller against another. This construction also provides a much easier assembly and disassembly of the apparatus, thus facilitating servicing and the replacement of parts.

More particularly, this invention provides a dampening system for an offset printing apparatus or the like, which includes means defining a water fountain, a fountain roller positioned so as to be partly immersed in water held in the water fountain, and a metering roller of which the axis is pivotally mounted for swinging movement about the axis of the fountain roller The metering roller is adapted to remain in contact with the fountain roller as it pivots about the fountain roller. The system further includes a form roller and drive means for positively rotating the form roller, and an oscillator roller in contact with the form roller. The system further includes means by which water can pass from the metering roller to the oscillator roller, the means being such that the metering roller is pressed by gravity against the surface of a receiving roller of which the axis lies in a horizontal plane below the horizontal plane containing the axis of the metering roller. Motor means are provided for driving the fountain roller in rotation.

GENERAL DESCRIPTION OF THE DRAWINGS

Two embodiments of this invention are illustrated in the accompanying drawings, in which like numerals denote like parts throughout both views, and in which.

DETAILED DESCRIPTION OF THE DRAWINGS

Figure 2:
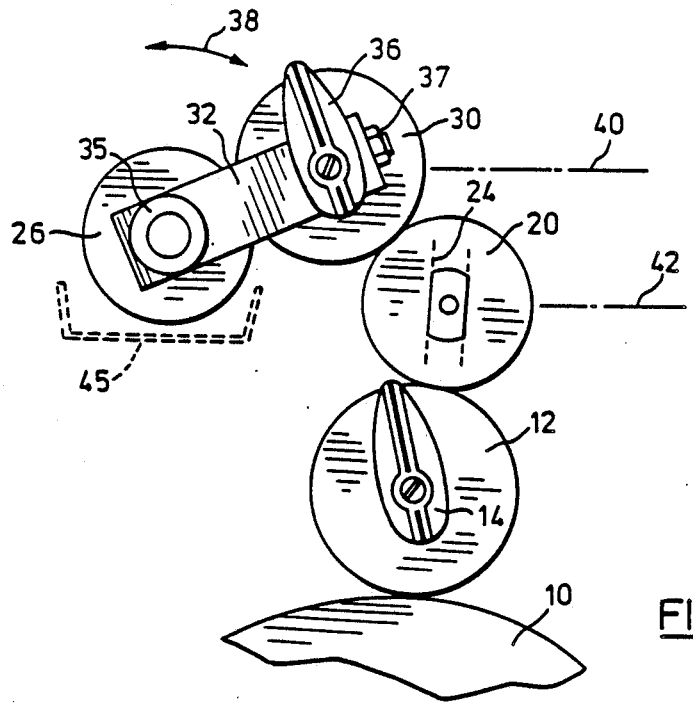
FIG. 2 is a somewhat schematic end view of the apparatus of FIG. 1, with certain portions removed to show the geometric relation between the various rollers.

Attention is first directed to FIG. 2, which shows the basic mutual relationship between the various rollers. The numeral 10 denotes a plate cylinder, which does not form an integral part of the dampening system of this invention. The plate cylinder holds on its surface the "plate" which in offset printing is a component treated in such a way that it holds water in certain locations and ink in others. The plate cylinder passes the ink pattern to a blanket cylinder (not shown) which in turn contacts a web or individual sheets intended to receive the ink, the web or sheets being passed through the nip between the blanket cylinder and an impression cylinder (not shown).

Above the plate cylinder 10 and in contact therewith is a form roller 12 which provides water to the plate cylinder 10. The form roller 12 has a conventional eccentric adjustment means whereby its axis may be moved vertically in order to adjust the pressure of contact between the form roller 12 and the plate cylinder 10. A manually rotatable knob 14 is provided for purposes of this adjustment. Looking now at both figures, the form roller 12 is supported between a plate 16 at the nearer end as seen in FIG. 1, and a gear-drive mechanism 18 at the further end in FIG. 1.

Mounted above the form roller 12 is an oscillator roller 20 of conventional construction except for having a rubber surface. The roller 20 incorporates two end blocks of which one is seen at 22. The oscillator roller axially oscillates with respect to the end blocks 22 and the latter are received in respective slots 24 (only one seen in FIG. 1) in which they are vertically movable. As can be seen, the slot 24 at the nearer end in FIG. 1 is upwardly open, which means that, so long as other rollers do not mechanically interfere, the oscillator roller 20 can be easily removed upwardly out of the slots 24. The slots 24 are sufficiently long to allow the oscillator roller 20 to rest by gravity against the form roller 12. In other words, the end blocks 22 are not normally positioned at the bottom of the slots 24.

Figure 1:
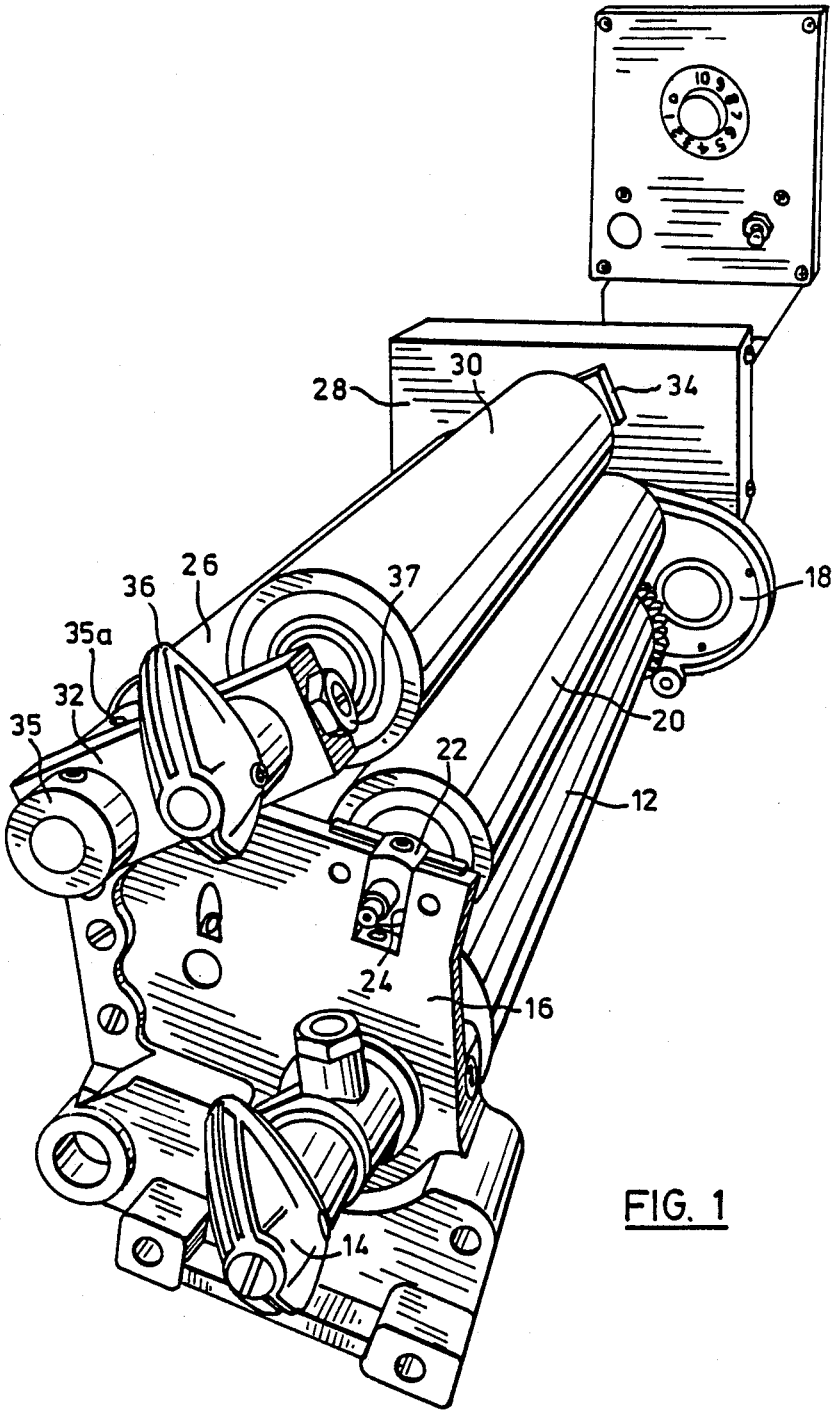
FIG. 1 is a perspective view of a dampening system constructed in accordance with one embodiment of this invention.

A fountain roller 26 is fixedly supported between the plate 16 and similar means at the further end in FIG. 1, the fountain roller being rotated by a motor means 28 which is adapted to provide a smooth, continuous and selectively variable drive for the roller 26. Drives of this kind are well known, and need not be described in detail in this specification.

A metering roller 30 is pivotally mounted for swinging movement about the axis of the fountain roller 26, so that the metering roller 30 can remain in contact with the fountain roller 26 regardless of the mutual angular position of the two rollers. More specifically, the metering roller is supported between two swing arms 32 and 34 which are pivoted about the axis of the fountain roller 26. The mounting mechanism for the metering roller 30 includes an eccentric adjustment means to allow a fine tuning of the pressure between the metering roller and the fountain roller 26. The eccentric adjustment means includes a control knob 35 which rotates a shaft within a cylindrical opening at the leftward end of the swing arm 32, the shaft in turn having an eccentric bore in which the central shaft of the fountain roller 26 is received. The shaft to which the knob 35 is connected can be secured in any given rotational orientation by a set screw 35*a*. Also included is a manual knob 36 which controls a further eccentric mounting at both ends of the metering roller 30. Rotation of the knob 36 shifts the axial position of the metering roller 30 longitudinally of the swing arms 32 and 34, but the eccentric member controlled by the knob 36 has circumferentially spaced recesses in which a spring-mounted detent (not visible in the figure) is adapted to register. The detent is held in place by the nut and bolt combination 37 in the rightward end of the swing arm 32. Thus, the knob 36 has the function of moving the metering roller 30 between a "contact" position and an "out of contact" position, these positions being determined by the location of the recesses.

Thus, the purpose of the swing arms 32 and 34 is to allow the metering roller 30 to perform arcuate movement in the direction shown by the two-headed arrow 38 in FIG. 2.

From the above description, it will be appreciated that contact between the oscillator roller 20 and the metering roller 30 takes place when the rollers are in a position such that the axis of the metering roller lies in a horizontal plane 40 which is above the horizontal plane 42 containing the axis of the oscillator roller 20. Due to this relative positioning, the metering roller 30 is pressed against the oscillator roller 20 by the action of gravity. It will be appreciated that, if the axis of the metering roller 30 and the oscillator roller 20 were in the same horizontal plane, they would not press together due to gravity.

It will further be understood that, by positioning the form roller 12 generally beneath the oscillator roller 20, the oscillator roller 20 is compressively sandwiched between the metering roller 30 and the form roller 12, again by the action of gravity.

Looking now at both figures, it will further be appreciated that removal of the oscillator roller 20 is extremely simple. One merely rotates the metering roller 30 in the counter-clockwise direction so that it does not lie against the oscillator roller 20, and then the latter can simply be lifted upwardly out of the slots 24. This permits cleaning of the various portions, replacement of the oscillator roller and easy repair.

In FIG. 2, a dotted outline 45 shows the position of a water fountain adapted to hold water into which the fountain roller can be partly immersed.

In a preferred method of operation, the fountain roller 26 would be driven at a slower speed than the rotational speed of the metering roller. The latter tends to rotate at the surface speed of the form roller, transmitted through the oscillator roller. The form roller is driven more quickly than the fountain roller.

In certain cases, it may be of advantage to provide a further roller, which may be called a transfer roller, between the metering roller 30 and the oscillator roller 20. This would allow a construction in which the axes of the metering roller and the oscillator roller are both located in horizontal planes above the axis of the transfer roller, with the oscillator roller being located above the form roller and the metering roller pivoted to and above the fountain roller. This arrangement is illustrated in FIG. 3, to which attention is now directed.

Figure 3:
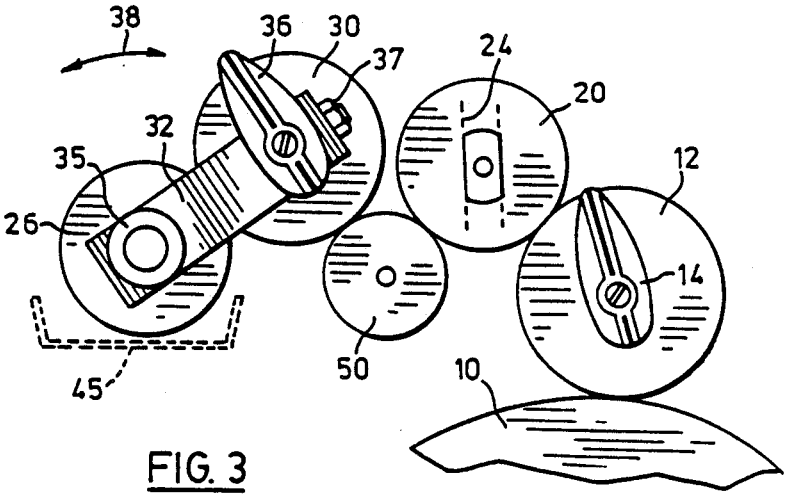
FIG. 3 is an end view of the second embodiment of this invention.

In FIG. 3, the fountain roller 26 and the metering roller 30 are identical to the corresponding rollers shown in FIG. 2, and all associated portions have the same reference numerals. The plate cylinder 10 and the form roller 12 are also substantially identical to the correspondingly numbered members in FIG. 2. In FIG. 3, the oscillator roller 20 is somewhat leftwardly offset from the form roller 12, but nonetheless is located such that its axis is located in a horizontal plane which is above the horizontal plane containing the axis of the form roller 12. This allows the oscillator roller 20 to be easily removed from its slots shown schematically by the broken lines 24 in FIG. 3. What is added in FIG. 3 is a transfer roller 50, which may be a stationary roller, in the sense that its axis does not move, while being free to rotate. The function of the transfer roller 50 is to pass water between the metering roller 30 and the oscillator roller 20. It will be seen from an inspection of FIG. 3 that the metering roller 30 is located such that its axis is in a horizontal plane above the plane containing the axis of the transfer roller 50, and that the same is true of the oscillator roller 20. This would permit the transfer roller 50 to be mounted in a manner similar to the oscillator roller 20, i.e. vertically slidable in suitable slots, with a "stop" at the bottom of each slot, to determine the normal position of the transfer roller 50.

The arrangement in FIG. 3 has the same advantages as the arrangement of FIG. 2 in regard to the fountain roller 26 and the metering roller 30. It also has the advantage of ready removability for the oscillator roller 20. It will be understood that the force of gravity maintains proper contact between the various rollers.

It will thus be understood that there has been provided an inexpensive and reliable system which is simple to assemble and disassemble, and requires a minimum of mechanisms which can wear out or malfunction. Furthermore, the construction described herein avoids the intermittent application of water through the system which produces uneven results in the first-described prior art construction utilizing a ductor roller as set forth at the beginning of this specification.

While one embodiment of this invention has been illustrated in the accompanying rawings and described hereinabove, it will be evident to those skilled in the art that changes and modifications may be made therein, without departing from the essence of this invention as set forth in the appended claims.

The embodiments of the invention in which an exclusive property or privilege as claimed are defined as follows:

1. A dampening system for an offset printing apparatus comprising:

means defining a water fountain;

a fountain roller positioned so as to be partly immersed in water held in said water fountain, the fountain roller having an axis of rotation;

a metering roller having an axis of rotation, the axis of the metering roller being pivotally mounted for swinging movement about the axis of the fountain roller, the metering roller being adapted to remain in contact with the fountain roller as it pivots about the fountain roller;

a form roller and drive means for positively rotating the form roller;

an oscillator roller in contact with the form roller and the metering roller, the oscillator roller having an axis lying in a horizontal plane below the horizontal plane containing the axis of the metering roller when the latter contacts the oscillator roller;

motor means for driving the fountain roller in rotation;

the form roller being located generally beneath the oscillator roller, the oscillator roller being supported between end blocks with respect to which it axially oscillates as it rotates, the end blocks being received in respective slots from which they can be generally upwardly removed thus removing the oscillator roller from the dampening system, the slots allowing the oscillator roller to rest by gravity against the form roller, whereby the oscillator is compressively sandwiched between the metering roller and the form roller.

2. The invention claimed in claim 1, in which the motor means is adapted to provide a smooth, continuous, selectively variable drive for the fountain roller, the drive being capable of rotating the fountain roller at a slower peripheral speed than the peripheral speed at which the form roller is driven.

3. The invention claimed in claim 2, in which the metering roller is supported between two swing arms pivoted about the axis of the fountain roller.

4. The invention claimed in claim 3, in which the swing arms incorporate eccentric adjustment means for fine-tuning the pressure between the fountain roller and the metering roller.

5. The invention claimed in claim 1, in which the metering roller is supported between two swing arms pivoted about the axis of the fountain roller.

6. A dampening system for an offset printing apparatus, comprising:

means defining a water fountain;

a fountain roller positioned so as to be partly immersed in water held in said water fountain, the fountain roller having an axis of rotation;

a metering roller having an axis of rotation, the axis of the metering roller being pivotally mounted for swinging movement about the axis of the fountain roller, the metering roller being adapted to remain in contact with the fountain roller as it pivots about the fountain roller;

a form roller and drive means for positively rotating the form roller;

an oscillator roller in contact with the form roller, the oscillator roller being supported between end blocks with respect to which it axially oscillates as it rotates, the end blocks being received in respective slots from which they can be generally upwardly removed thus removing the oscillator roller from the dampening system;

a transfer roller having an axis lying in a horizontal plane below the horizontal plane containing the axis of the oscillator roller; the metering roller in one operative position resting by gravity against the transfer roller, the axis of the transfer roller lying in a horizontal plane below the horizontal plane containing the axis of the metering roller when in said operative position;

the said slots being positioned such as to allow the oscillator roller to rest by gravity simultaneously against both the form roller and the transfer roller, whereby it is easily removable;

and motor means for driving the fountain roller in rotation.

7. The invention claimed in claim 6, in which the motor means is adapted to provide a smooth, continuous, selectively variable drive for the fountain roller, the drive being capable of rotating the fountain roller at a slower peripheral speed than the peripheral speed at which the form roller is driven.

8. The invention claimed in claim 6, in which the metering roller is supported between two swing arms pivoted about the axis of the fountain roller.

9. The invention claimed in claim 8, in which the motor means is adapted to provide a smooth, continuous, selectively variable drive for the fountain roller, the drive being capable of rotating the fountain roller at a slower peripheral speed than the peripheral speed at which the form roller is driven.

10. The invention claimed in claim 9, in which the swing arms incorporate eccentric adjustment means for fine-tuning the pressure between the fountain roller and the metering roller.

* * * * *